United States Patent [19]

Carr

[11] Patent Number: 4,813,665

[45] Date of Patent: Mar. 21, 1989

[54] AEROBIC SKIPPING EXERCISE DEVICE

[76] Inventor: Jim L. Carr, 724 W. Division, Springfield, Mo. 65802

[21] Appl. No.: 197,521

[22] Filed: May 23, 1988

[51] Int. Cl.[4] ..... A63B 5/20

[52] U.S. Cl. ..... 272/75; 272/74; 272/70; 272/DIG. 5

[58] Field of Search ..... 272/75, 74, 70, DIG. 5

[56] References Cited

U.S. PATENT DOCUMENTS

| | | | |
|---|---|---|---|
| 3,241,832 | 3/1966 | Miller | 272/74 |
| 3,589,718 | 6/1971 | Bessler | 272/74 |
| 3,589,719 | 6/1971 | Glass | 272/74 |
| 3,834,702 | 9/1974 | Bliss | 272/70 |
| 4,082,266 | 4/1978 | Elkins | 272/75 |
| 4,216,956 | 8/1980 | Yamamura et al. | 272/70 |
| 4,699,375 | 10/1987 | Appelbaum et al. | 272/75 X |
| 4,739,985 | 4/1988 | Rudell et al. | 272/75 X |

FOREIGN PATENT DOCUMENTS

| | | | |
|---|---|---|---|
| 0111928 | 9/1979 | Japan | 272/70 |

*Primary Examiner*—Richard J. Apley
*Assistant Examiner*—Joe H. Cheng
*Attorney, Agent, or Firm*—Alan B. Samlan; Basil E. Demeur

[57] ABSTRACT

An exercise apparatus for aerobic conditioning of a person having a flexible rod over which the person must jump in accordance with a rhythmic cadence. A variable speed control device controls the speed of movement of the rod. A light beam may be utilized to replace the flexible rod. The user jumps onto a shock absorbing medium to reduce the shock to the exoskeleton system.

13 Claims, 2 Drawing Sheets

AEROBIC SKIPPING EXERCISE DEVICE

BACKGROUND AND SUMMARY OF THE INVENTION

This invention relates to exercise apparatus and more particularly to an exercise apparatus which promotes the physical exercise of jumping or "skipping" for the attainment of aerobic and anaerobic exercise with the end purpose being the improvement of the user's cardiovascular system.

The most commonly used method for jumping or skipping as an aerobic or anaerobic exercise required the use of a jump rope. A jump rope has many shortcomings. One shortcoming is that it can strike or catch upon objects or accidentally strike persons in the near vicinity of its swinging arc. To use a jump rope in a skipping exercise, the area must be completely cleared of all objects so that accidental damage will not occur when using the rope. If the user wishes to perform areobic skipping at home, especially in one of the living areas, the user runs a great risk of damaging or destroying fragile objects in the area where the activity will be performed. Furthermore, the use of a jump rope may not be possible because of the rope striking the ceiling. Thus, an area with a fairly high ceiling is essential in order to use a jump rope.

Another problem which must be overcome with the use of a jump rope in an exercise class is the substantial amount of space required for each person to use the jump rope. The total amount of clear space required when one uses a jump rope is approximately 18.8 cubic feet for a rope of 6 feet in length. It can quickly be seen that in an exercise class at a fitness center there is a limited number of individuals who can participate in rope jumping simultaneously. Also, in a fitness center or exercise room there is the continued movement of people in and about the room which raises the possibility of one of these persons being struck by the rope. A jump rope can cause serious injuries such as trauma or loss of an eye to a person who may unknowingly venture within the arc of the swinging rope.

Another problem with a jump rope, especially in a health club or a fitness center environment, is that all persons in the class may not be able to jump rope. Even though this apparently child-like activity may appear to be able to be performed by everyone, such is not the case. Therefore, without at least a minimum amount of practice, some people may not be able to perform the exercises without practicing and developing the necessary rhythm.

Another shortcoming with the use of a jump rope is that the user's hands and arms are in constant use in order to move the rope. The user's hands and arms can become quite tired and can cause the user to slow down or even discontinue the activity because of the discomfort or tiredness in these extremities. Thus, the user does not achieve the desired stress on the cardio-vascular system.

Applicant's invention promotes the attainment and sustaining of aerobic exercise by providing an impact striking means which may be a flexible rod or a light beam which the user jumps over in a rhythmic cadence according to a pre-set time cycle. In an alternate embodiment of the invention, the device has two foot pads upon which the user jumps alternately. There are lights or an audio signal which provides the preset and variable timed cadence for the jumps.

In the embodiment utilizing a flexible rod over which the user must jump, a small motor and motor control mechanism is connected to the rod to have the rod move up and back across the jumping area. The user can increase or decrease the speed of the motor thereby regulating the speed of the flexible rod. A timer provides the time interval during which the flexible rod will continue to move and thus controls the time during which the user will continue the exercise. The flexible rod can be replaced by a light beam and photoelectric cell. Instead of jumping over the flexible rod, the user must jump over the light beam.

Accordingly, it is an object of the present invention to provide an improved aerobic and anaerobic skipping or jumping exercise device which eliminates the need of a jump rope. Related to this object is the object of providing an exercise which performs the same function as a jump rope yet provides the same exercise in a smaller space.

Another object is to provide a jumping exercise device which is safer than a jump rope while still providing the same exercise benefits.

Yet another object is the object of providing an exercise device which has a variable timer whereby the user can preset the frequency of the jumping or skipping.

Yet another object is the object of providing an exercise device that can be powered by either alternating current or direct current supplied by batteries. Related to this object is the object of providing such an exercise device which is portable and can be utilized in a remote area where alternating household current is not available.

Another object is to provide an exercise device having a flexible rod over which the user must jump with the end or the entire flexible rod illuminated so that the device can be used in a dark environment. This provides the user with the flexibility of using the device in a darkened room without disturbing others who may be sleeping.

Yet another object is the object of providing an exercise device which has audio output means for either a cassette or voice synthesized microchip to convey selected information or a rhythmic beat to the user.

Still another object is the object of providing a jumping or skipping exercise device which does not tire the user's hands or arms while the user is performing the exercise.

These and other objects and advantages of the invention will become apparent from the following detailed description when read in conjunction with the drawings.

DETAILED DESCRIPTION OF THE PREFERRED EMBODIMENT

Figure 1:
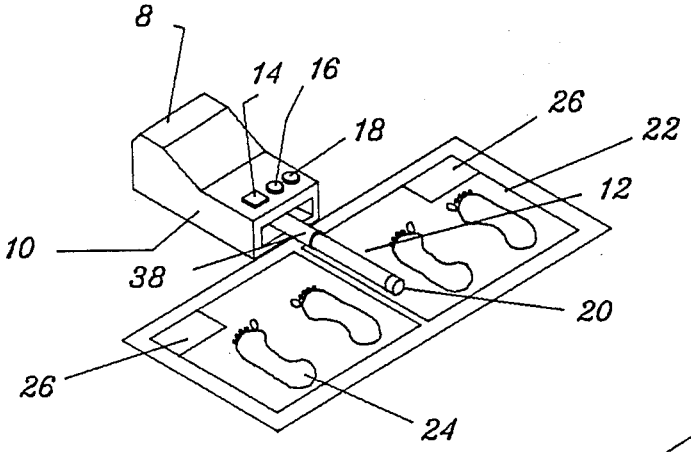
FIG. 1 is a perspective view of the skipping or jumping device in which the user must jump over a flexible rod as it reciprocates up and back through an arc.

Turning first to FIG. 1, there is illustrated an exercise device 8 of the present invention. The device 8 must rest on a flat and stable surface. The exercise device 8 has an outer housing 10 having a flexible rod 12 extending outward from the front of the device. On the housing 10 is an on/off switch 14, speed control knob 16 and a timer control switch 18. The end of the flexible rod 12 may be provided with an illuminated tip 20 which can be turned on separately or in conjunction with the on/-off switch 14. There is a shock absorbing mat 22 which may be fastened to or separate from the housing 10. However, when the device 8 is to be used, the shock absorbing mat 22 must be placed under the flexible rod 12 such as illustrate in FIG. 1. Footprints 24 are overlaid on the mat 22 to indicate the position where the user should stand. Instructions or other exercise tips may be placed in the areas indicated as 26.

Figure 2:
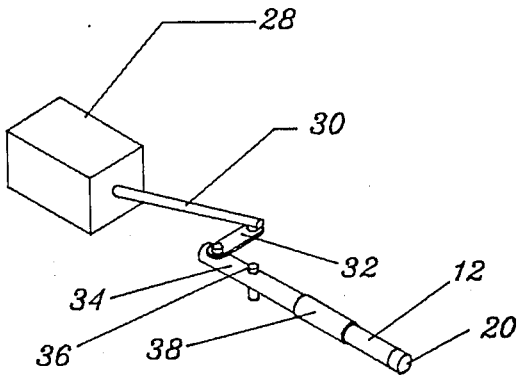
FIG. 2 is a perspective view of the motor and linkage arrangement used to cause the flexible rod to reciprocate.

FIG. 2 illustrates the drive mechanism of the exercise device 8. There is a motor and gear unit 28 which is similar to a windshield wiper mechanism found on most automobiles. A first link 30 extends outward from the motor and gear unit 28. One end of the link 30 is operatively connected to the motor and gear unit 28 and the other end is fixedly connected to a second link 32. The second link 32 has its outer end fixedly connected to a driven link 34 which is mounted for pivotal rotation about a pivot pin 36. The outer end of the driven link 34 is connected through a coupling 38 to the flexible rod 12.

When the on/off switch 14 is turned to the "on" position, the motor and gear unit 28 is energized. This causes the first link 30 to reciprocate back and forth in an arc segment. The speed of the motor 28 is controlled by means of the speed control knob 16 connected to a suitable speed control circuit. Thus, the speed of the flexible rod 12 as it moves up and back through its arc can be controlled. With the user standing on one side of the flexible rod 12, the device is turned on and the rod begins to swing through its arc segment. As the rod 12 reciprocates up and back, it defines a jump area. Each time the rod approaches the person's feet, he must jump over it. The person can jump from side to side over the rod or stand in the middle and merely jump vertically each time the rod passes beneath him. The total length of time of the exercise period can be set with the timer control switch 18.

Figure 3:
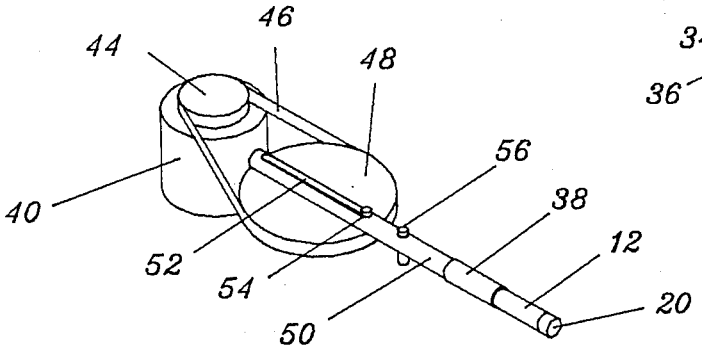
FIG. 3 is an alternate embodiment of a motor and linkage arrangement used to cause the flexible rod to reciprocate.

FIG. 3 illustrates another embodiment in which the drive mechanism has a continuously driven motor 40 which has its output connected to a pulley 44, belt 46 and driven pulley 48. The driven pulley 48 will be driven in a 360° circle. A driven link 50 has a slot 52 at one end thereof. A guide pin 54 attached to a radial point on the pulley 48 rides in the slot 52. As the link 50 is pivotally connected to a pivot pin 56, it has its outermost end driven in a arc segment as the pulley 48 rotates. The coupling 38 connects the outermost end of the link 50 to the rod 12. The result is that the flexible rod 12 is moved back and forth in an arc segment similar to the arc segments previously described.

Figure 4:
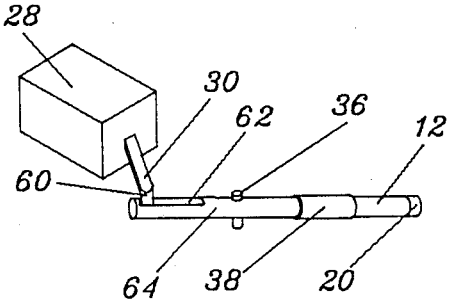
FIG. 4 is another alternate embodiment of a motor an linkage arrangement used to cause the reciprocation of the flexible rod.

FIG. 4 illustrates yet another drive mechanism which causes the flexible rod 12 to pivot back and forth over the jumping area. The motor and gear unit 28 drives the first link 30 in an arc segment. At the end of the first link 30 is a down-turned finger 60 which rides in a slot 62 at one end of a link 64. As the finger 60 is captively retained within the slot 62, continued movement of the first link 30 will cause the link 64 to reciprocate back and forth about the pivot pin 36 as the motor and gear unit 28 drives the first link 30 in the back and forth movement. This causes the reciprocation of the rod 12.

Figure 5:
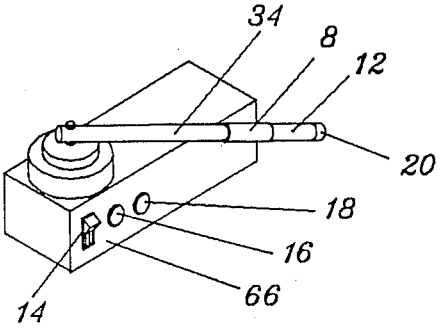
FIG. 5 is another alternate embodiment in which the flexible rod rotates about a 360° circle and in which the user must jump over the flexible rod once each revolution.

FIG. 5 illustrates another embodiment in which the continuously driven motor 44 is connected through an appropriate drive mechanism to the driven link 34. As the output from the motor revolves, the flexible rod 12 will pass underneath the user once each revolution. The user thus must jump over the rod 12 according to the timed cadence established by the speed control knob 16. The motor 44 and associated control mechanisms are mounted in a housing 66 which can be manufactured of metal or plastic with a non-skid bottom.

Figure 6:
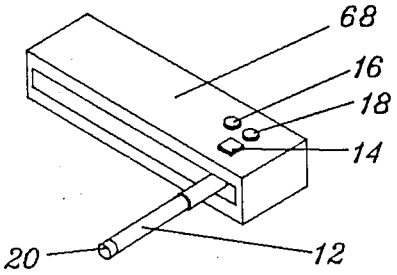
FIG. 6 is yet another alternate embodiment in which the flexible rod is driven by a linear bi-directional motor which causes the flexible rod to move up and back across the predetermined jump area.

In FIG. 6, there is yet another embodiment in which a rectangular housing 68 contains a linear motor (not illustrated). The motor is directly connected to the flexible rod 12 by means of a suitable coupling. The travel of the rod 12 is controlled by the travel of the linear motor as it moves up and back in the rectangular housing 68. The user will thus jump over the rod 12 each time it passes beneath him. Suitable speed control, on/off and timer switches are provided.

Figure 7:
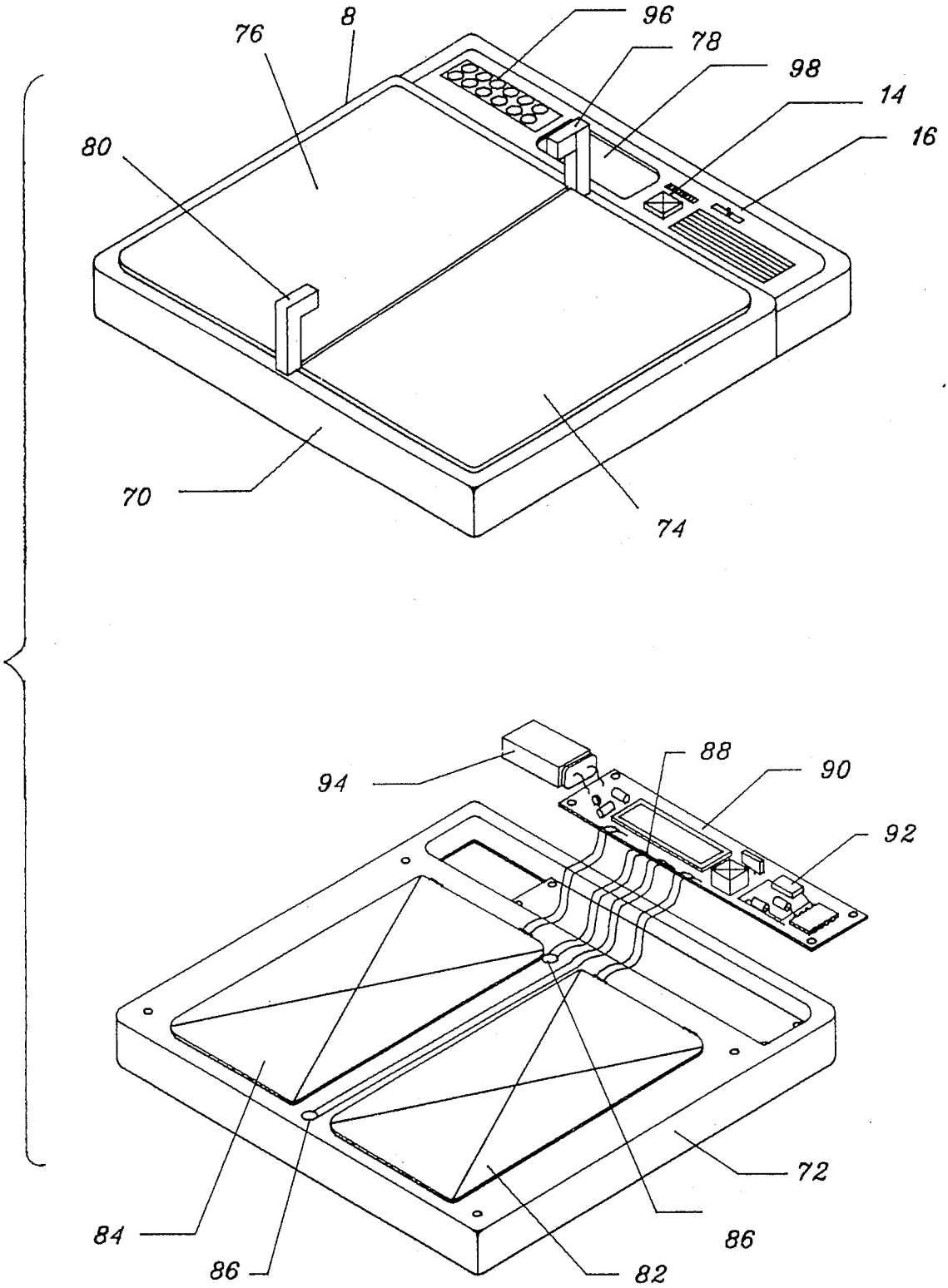
FIG. 7 is a perspective exploded view of an electronic version of the invention in which the user must jump over a light beam in response to a timed output signal.

FIG. 7 illustrates an electronic embodiment of the exercise device 8. A cover 70 is manufactured of injection or blow-molded plastic. A base 72 is manufactured of suitable material to support the weight of a person continually jumping thereon. On the cover 70 is a right jumping surface 74 and left jumping surface 76. A light source 78 and photoelectric receiver cell 80 are mounted on the top of the cover 70 and placed a suitable height above the top of the jumping surfaces 74 and 76. This height may be adjustable by means of suitable height adjustment mechanisms attached to the light source 78 and photoelectric receiver cell 80. Beneath the jumping surfaces is a right foot pad 82 and left foot pad 84 which are shock absorbing materials to reduce the shock to the user's exoskeleton, muscles, joints and nerve endings. The light source 78 and photoelectric cell 80 are connected by suitable connection means 86 having wires 88 leading to an electronic circuit board 90 with an electronic control system 92. Power can be supplied through a battery 94, household current, or photoelectric cells 96.

In this embodiment, instead of having a rod to jump over, the user stands on the right or left jumping surfaces 74 or 76 and watches an information panel 98. The panel may have a light source or give another signal which indicates that the user is to jump from one surface over the light beam to the other surface. If the light beam is interrupted by the user, and audio signal can be emitted indicating that the user is not jumping high enough. By controlling the speed of the signal on the information panel 98, the user is advised of the proper time to jump and the cadence is established. The device can also be designed with electrical connections 88 leading from the right and left foot pads 82 and 84 to indicate when the user has landed on the appropriate pad and if he is jumping in accordance with the predetermined cadence. Alternatively, the cadence can be set by a time delay established after the person lands on the appropriate foot pad. The particular method of establishing the cadence is not critical except that a cadence must be established which causes the user to maintain a sufficient speed of continuous jumping to provide the proper aerobic exercise level for a particular user.

The exercise device 8 can be provided with additional features. Depending upon the speed of movement of the flexible rod 12 or speed established on the panel 98 in FIG. 7, there may be a series of lights or levels displayed on the housing 10 or cover 70. The level or number of lights illuminated would depend upon the performance level achieved by the user. Similarly, various lights or levels may be energized depending upon the particular phase or length of time that the user has been jumping. At the end of the programmed exercise, the particular configuration of lights could flash to indicate that the user had completed the full phase of the exercise. This could be controlled along with the timer control switch 18 such that the motor would turn off at the appropriate time.

The exercise device can also be designed to accommodate an audio tape player to give instructions or exercise programs to the user. Music or other tapes could be played so that the user can relax and listen while exercising.

The base of the exercise device 8 or base 72 and the shock absorbing mat 22 must be of a non-slip material. Thus, when the user is jumping, the area upon which he is jumping will not slip which may result in injury to the user. It can also be seen that by having a lighted end 20 on the flexible rod 12 the device can be used in a darkened environment without disturbing others.

It can also be seen that the exercise device occupies a minimal amount of floor space, especially as compared to a jump rope. Thus, in a health club environment, many users can derive the benefits of the cardiovascular exercises without the danger of being hit by a jump rope or bumping into an adjacent person.

Thus, there has been provided in accordance with the invention an aerobic exercise device that fully satisfies the objects, aims, and advantages set forth above. While the invention has been described in conjunction with specific embodiments thereof, it is evident that many alternatives, modifications, and variations will be apparent to those skilled in the art in light of the forgoing description. Accordingly, it is intended to embrace all such alternatives, modifications, and variations as fall within the spirit and broad scope of the appended claims.

What is claimed is:

1. An exercise apparatus for aerobic conditioning of a person comprising:

a rod having opposite ends, the rod creating a barrier over which the person must jump;

a variable speed motor;

a motor controller operatively connected to the variable speed motor for controlling the motor speed;

a mechanical linkage connecting the motor to one end of the rod, the motor and mechanical linkage causing the rod to reciprocate across a jump zone defined by the area beneath the rod as it reciprocates, the motor controller varying the motor speed and the speed of reciprocation of the rod with the person jumping over the rod in a rhythmic cadance which corresponds to the timing interval of the reciprocation of the rod as it moves back and forth across the jump zone; and a light source associated with the rod which can be seen by the person regardless of ambient light.

2. The apparatus of claim 1 and further comprising a jump pad positioned beneath the rod and in the jump zone on which the person stands and jumps.

3. The apparatus of claim 2 and further comprising a housing which contains the variable speed control.

4. The apparatus of claim 1 wherein the motor and mechanical linkage causes the rod to reciprocate back and forth in an arc across the jump zone.

5. The apparatus of claim 1 wherein the light source is a light at the other end of the rod which can be seen by the person regardless of ambient light.

6. The apparatus of claim 1 wherein the light source is a luminescent rod which can be seen by the person regardless of ambient light.

7. The apparatus of claim 1 wherein the rod is a flexible rod.

8. The apparatus of claim 1 and further comprising a timer device to control the time during which the motor will be energized and in turn the length of time the person will be jumping over the rod.

9. An exercise apparatus for aerobic conditioning comprising:

a flexible rod creating a barrier over which a person must jump;

a variable speed motor;

control means connected to the motor for controlling the speed of the motor;

linkage means operatively connecting the flexible rod to the variable speed motor; and pivot means fixing the flexible rod so that the rod can move in an arc about the pivot means, the arc defining a jump zone, whereby the person jumps over the flexible rod as it moves across the jump zone.

10. The apparatus of claim 9 wherein the motor and linkage cause the rod to reciprocate back and forth across the jump zone.

11. An exercise apparatus for aerobic conditioning comprising:

a flexible rod creating a barrier over which a person must jump;

a linear variable speed motor, the motor reciprocating up and back across a predetermined area;

a jump zone defined by the path of the flexible rod as it moves up and back across the predetermined area;

control means connected to the motor for controlling the speed of the motor; and coupling means for connecting the flexible rod to the linear variable speed motor, whereby the person jumps over the flexible rod as it moves across the jump zone.

12. The apparatus of claim 11 and further comprising a timer device to control the time during which the motor will be energized.

13. An exercise apparatus for aerobic conditioning comprising:

a reciprocating impact striking means for creating a barrier over which a person must jump;

a jump zone defined by the area beneath the impact striking means as it reciprocates, the person jumping over the impact striking means and staying in the jump zone;

a variable speed motor connected to the impact striking means; and a variable timing control device for establishing timing intervals, whereby in each timing interval the person jumps over the impact striking means each time it passes beneath the person.

* * * * *